US008297257B2

(12) United States Patent
Sugiyama et al.

(10) Patent No.: US 8,297,257 B2
(45) Date of Patent: Oct. 30, 2012

(54) FUEL SUPPLY PIPE DEVICE AND FUEL INJECTION DEVICE HAVING THE SAME

(75) Inventors: Kouichi Sugiyama, Nagoya (JP); Yoshinori Yamashita, Kariya (JP); Hideaki Ichihara, Obu (JP); Hidekazu Oomura, Hekinan (JP); Hideki Suzuki, Chita-gun (JP)

(73) Assignee: Denso Corporation, Kariya (JP)

( * ) Notice: Subject to any disclaimer, the term of this patent is extended or adjusted under 35 U.S.C. 154(b) by 895 days.

(21) Appl. No.: 12/407,377

(22) Filed: Mar. 19, 2009

(65) Prior Publication Data

US 2009/0241904 A1 Oct. 1, 2009

(30) Foreign Application Priority Data

Mar. 26, 2008 (JP) ..... 2008-80112
Mar. 27, 2008 (JP) ..... 2008-82750

(51) Int. Cl.
*F02M 69/50* (2006.01)
*F02M 69/46* (2006.01)

(52) U.S. Cl. ..... 123/456; 123/470

(58) Field of Classification Search ..... 123/456, 123/447, 468, 469, 470, 299, 304, 308, 432
See application file for complete search history.

(56) References Cited

U.S. PATENT DOCUMENTS 5,168,856 A * 12/1992 Lorraine ..... 123/468
5,201,806 A 4/1993 Wood
5,433,182 A * 7/1995 Augustin et al. ..... 123/456
5,445,130 A * 8/1995 Brummer et al. ..... 123/456
5,595,160 A 1/1997 Matsumoto et al.
5,954,031 A * 9/1999 Ogiso et al. ..... 123/447
6,807,944 B2 10/2004 Mizuno et al.
7,063,070 B2 * 6/2006 Mashiki ..... 123/431
2004/0069277 A1 * 4/2004 Mizuno et al. ..... 123/456
2005/0045155 A1 * 3/2005 Harvey et al. ..... 123/470
2007/0034192 A1 * 2/2007 Kamio et al. ..... 123/478

FOREIGN PATENT DOCUMENTS

JP 60-101275 6/1985
JP 2003-239824 8/2003
JP 2005-220875 8/2005
JP 2006-125333 5/2006
JP 2007-309121 11/2007

OTHER PUBLICATIONS

Japanese Office Action dated Feb. 9, 2010, issued in corresponding Japanese Application No. 2008-080112, with English translation.
Japanese Office Action dated Feb. 9, 2010, issued in corresponding Japanese Application No. 2008-082750, with English translation.

* cited by examiner

*Primary Examiner* — Mahmoud Gimie
(74) *Attorney, Agent, or Firm* — Nixon & Vanderhye PC

(57) ABSTRACT

An internal combustion engine has multiple cylinders each provided with multiple injectors. A fuel supply pipe device includes multiple fuel passages, which receive fuel through multiple fuel paths and supply the fuel correspondingly to the multiple injectors. The multiple fuel passages are separated respectively from the multiple fuel passages.

21 Claims, 17 Drawing Sheets

FUEL SUPPLY PIPE DEVICE AND FUEL INJECTION DEVICE HAVING THE SAME

CROSS REFERENCE TO RELATED APPLICATIONS

This application is based on and incorporates herein by reference Japanese Patent Applications No. 2008-80112 filed on Mar. 26, 2008 and No. 2008-82750 filed on Mar. 27, 2008.

FIELD OF THE INVENTION

The present invention relates to a fuel supply pipe device for supplying fuel to another device such as an internal combustion engine. The present invention further relates to a fuel injection device having the fuel supply pipe device for injecting fuel in an internal combustion engine.

BACKGROUND OF THE INVENTION

In a conventional internal combustion engine for an automobile, each cylinder is provided with one fuel injection valve. In such a conventional engine, the same number of fuel injection valves as the number of the cylinders are mounted to a fuel supply pipe device, which supplies fuel to the fuel injection valves. In recent years, for example, JP-A-2005-220875 and JP-A-2006-125333 propose a twin injection engine, in which two fuel injection valves are provided respectively to two intake valves in each cylinder. In the present structure, two fuel injection valves are provided in each cylinder, and therefore the number of the fuel injection valves, which need to be mounted to a common fuel delivery pipe of the fuel supply pipe device, becomes twice, compared with the conventional engine in which one fuel injection valve is provided in each cylinder. Furthermore, in the twin injection engine, two adjacent fuel injection valves in each cylinder are significantly close to each other. Accordingly, a mounting work of the fuel injection valves to the fuel delivery pipe, an exchanging work of the fuel injection valves in a case of malfunction, and electric wiring to the fuel injection valves are difficult in the twin injection engine. In addition, since the number of the fuel injection valves mounted to the fuel delivery pipe becomes twice, load exerted to the fuel delivery pipe increases, and therefore mountability of the fuel delivery pipe to the internal combustion engine may be impaired. In addition, pulsation may be significantly caused in fuel supplied from the fuel delivery pipe to the fuel injection valve, and therefore fuel supply and fuel injection may become unstable.

For example, in a conventional fuel injection device of JP-A-2006-125333, fuel supplied from a fuel pump is accumulated in a delivery pipe, and the fuel is supplied from the delivery pipe and injected from injectors in an internal combustion engine. A cylinder head of a multi-cylinder internal combustion engines is provided with injectors. More specifically, two injectors are provided in each cylinder, and all the injectors are connected to a fuel passage, which is one inner space, in the delivery pipe. In the fuel injection device of JP-A-2005-220875, two injectors are provided to one throttle body of an engine. The delivery pipe includes a first pipe, to which one of the two injectors is connected, a second pipe, to which the other of the two injectors is connected, and a communication pipe, which communicates both the first and second pipes with each other. Fuel is supplied from a fuel pump, and the fuel flows from the first pipe through the communication pipe into the second pipe. In the fuel injection device of JP-A-2006-125333, all the injectors are connected to the one inner space of the delivery pipe. In addition, two injectors are synchronously manipulated in response to its closing operation, and accordingly pulsations are caused at two locations in the delivery pipe. Thus, the pulsations interfere with each other to be amplified in the delivery pipe. As a result, quantity of fuel injected from injectors becomes unstable. In the fuel injection device of JP-A-2005-220875, the fuel supply pipe device including the two delivery pipes and the communication pipe has the one common inner space. Therefore, pulsation is amplified in the one common inner space inside the fuel supply pipe device, and consequently quantity of fuel injected from each of the injectors becomes unstable. Furthermore, the fuel injection device of JP-A-2005-220875 includes the two delivery pipes and the communication pipe, and therefore the structure is complicated and increased in size.

SUMMARY OF THE INVENTION

In view of the foregoing and other problems, it is one object of the present invention to produce a fuel supply pipe device, which is configured to be mounted with fuel injectors and capable of stabilizing quantity of fuel supplied to the fuel injectors. It is one object to produce a fuel supply pipe device, which can be easily mounted with the fuel injection valves. It is one object to produce a fuel supply pipe device, which can be easily mounted to and detached from the internal combustion engine. It is one object to produce a fuel supply pipe device, which has a downsized simple structure.

According to one aspect of the present invention, a fuel supply pipe device for an internal combustion engine, which has a plurality of cylinders each provided with a plurality of injectors, the fuel supply pipe device comprises a plurality of fuel passages, which are configured to receive fuel through a plurality of fuel paths and supply the fuel correspondingly to the plurality of injectors. The plurality of fuel passages are separated respectively from the plurality of fuel passages.

According to one aspect of the present invention, the plurality of fuel passages includes a first fuel passage, which is defined in a first delivery pipe and configured to receive fuel through a first fuel path of the plurality of fuel paths and supply the fuel to at least one of the plurality of injectors. The plurality of fuel passages includes a second fuel passage, which is defined in a second delivery pipe and configured to receive fuel through a second fuel path of the plurality of fuel paths and supply the fuel to the other of the plurality of injectors. The first delivery pipe and the second delivery pipe are configured to be combined such that all the plurality of injectors are substantially linearly arranged.

According to one aspect of the present invention, a number of the plurality of fuel passages is the same as a number of the plurality of injectors in each cylinder. The plurality of fuel passages is partitioned from each other by a partition wall in a delivery pipe. The plurality of fuel passages is supplied with fuel respectively through the plurality of fuel paths, which are separated from each other. The plurality of injectors are separately connected respectively to the plurality of fuel passages in each cylinder.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

A fuel supply pipe device according to the present first embodiment will be described with reference to drawings. As shown in FIGS. 1 to 5, a fuel delivery pipe 4 (FIG. 3) according to the present first embodiment is used for an internal combustion engine 1 for supplying fuel to each of fuel injection valves (injectors) 5. In the internal combustion engine 1, each of cylinders S has two intake valves 23 each correspondingly provided with each of two injectors 5. According to the present embodiment, the engine 1 is an inline four-cylinder engine in which four cylinders S including a first cylinder S1 to a fourth cylinder S4 are located in series.

Figure 1:
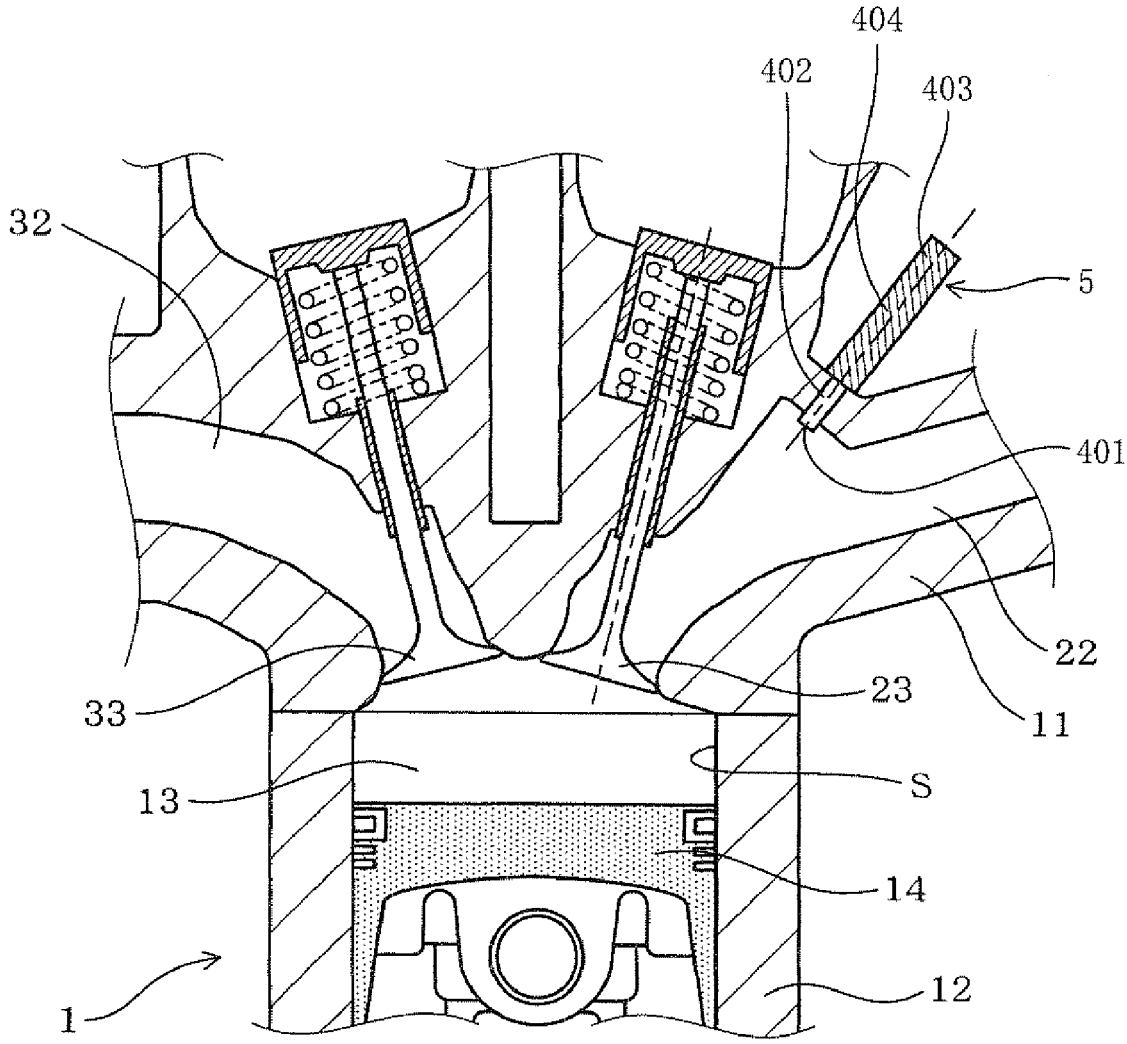
FIG. 1 is a schematic lateral view showing a cylinder of an internal combustion engine according to a first embodiment.
Figure 2:
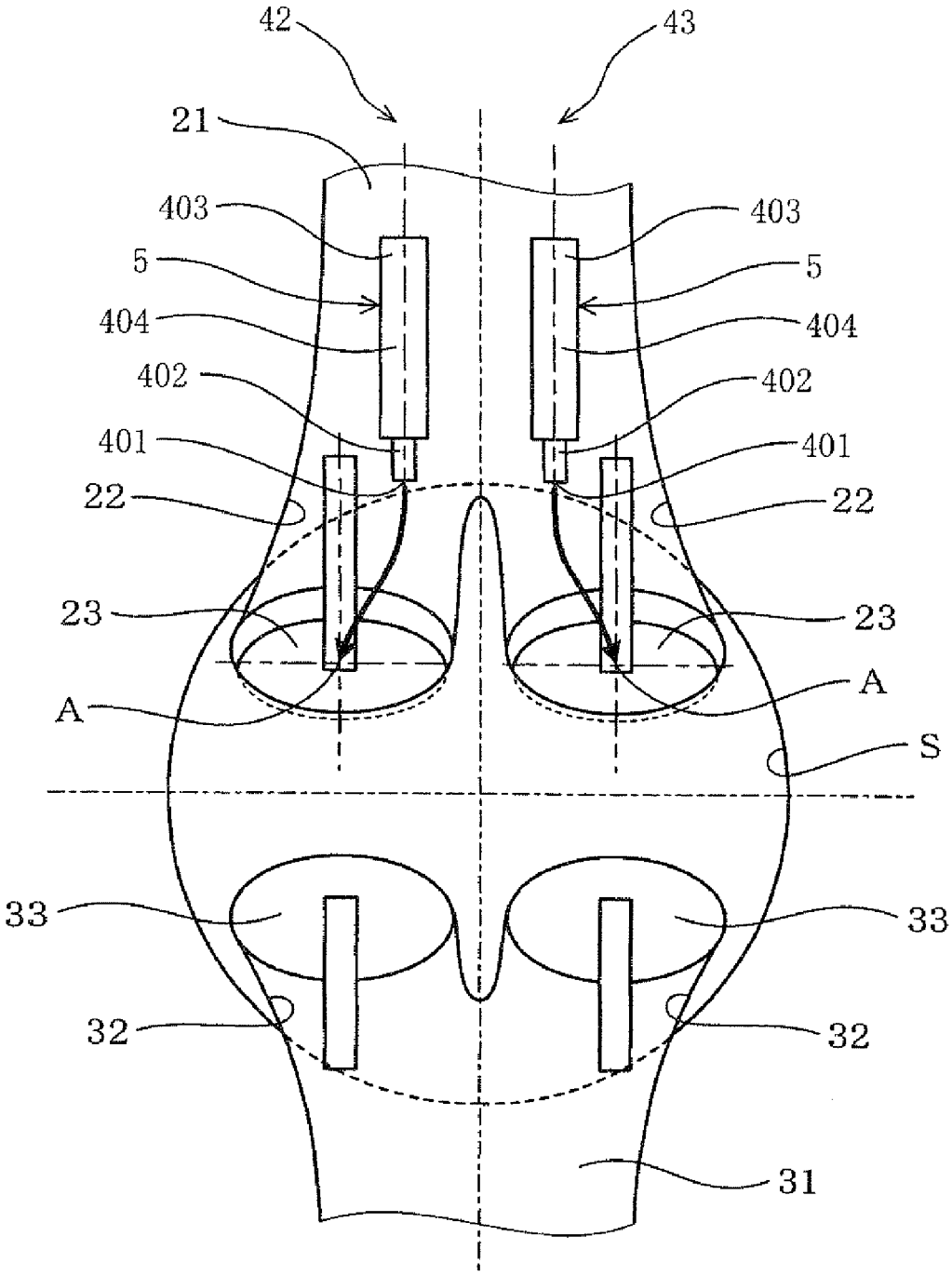
FIG. 2 is a schematic top view showing intake valves and injectors when being viewed along the axial direction of the cylinder according to the first embodiment.
Figure 3:
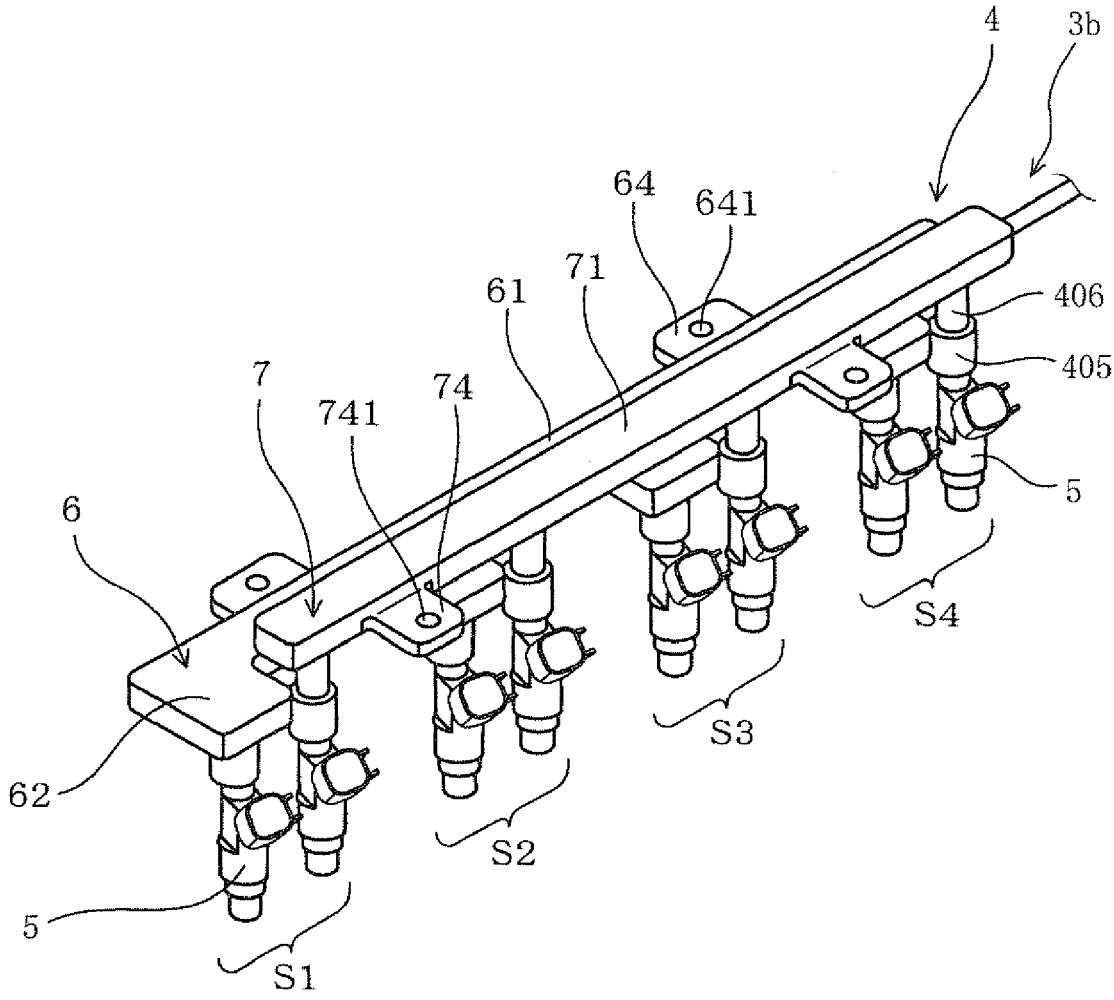
FIG. 3 is a perspective view showing a first fuel delivery pipe and a second fuel delivery pipe according to the first embodiment.

As follows, the structure of the engine 1 will be described in detail. As shown in FIGS. 1, 2, in the engine 1, each cylinder S is provided with two intake ports 22, the two intake valves 23, and two injectors 5. Each of the two intake ports 22 opens to a combustion chamber 13. Each of the two intake valves 23 opens and closes corresponding one of the intake ports 22. Each of the two injectors 5 is provided to corresponding one of the intake valves 23. The two injectors 5 are substantially in parallel with each other. An intake pipe 21, which defines one intake passage, is located upstream of the two intake ports 22. The two intake ports 22 branch from the one intake passage of the intake pipe 21 into two passages and are substantially in a Y-shape. In the engine 1, each cylinder S has two exhaust ports 32 and two exhaust valves 33. Each of the two exhaust valves 33 opens and closes the corresponding one of the two exhaust ports 32. An exhaust pipe 31, which defines one common exhaust passage, is located downstream of the two exhaust ports 32. The two exhaust ports 32 are two passages substantially in a Y-shape and merge into the common exhaust passage of the exhaust pipe 31. A cylinder block 12 has the cylinders S, in each of which a piston 14 is slidably provided. Each piston 14 moves in response to combustion of fuel in corresponding one of the combustion chambers 13. Each of the two injectors 5 is provided to corresponding one of the two intake ports 22 and corresponding one of the two intake valves 23. Each injector 5 has a tip end 402, which has a nozzle hole 401 for injecting fuel therethrough. The tip end 402 protrudes into the intake port 22, and the tip end 402 is directed toward the intake valve 23. Each injector 5 has a rear end 403 at the opposite side of the tip end 402. The rear end 403 protrudes outside of a cylinder head 11. As shown in FIG. 3, each injector 5 is supplied with fuel from the fuel delivery pipe 4. The injector 5 has a body 404 in which a needle (not shown) is movable in the axial direction. The needle, which is seated to the valve seat (not shown) of the body 404, is lifted from the valve seat, and thereby fuel is injected from the nozzle hole 401 to a center A of the intake valve 23. The needle is again seated to the valve seat and thereby stopping the injection of fuel. In the present structure, injection of fuel is intermittently performed according to the state of the needle.

Figure 4:
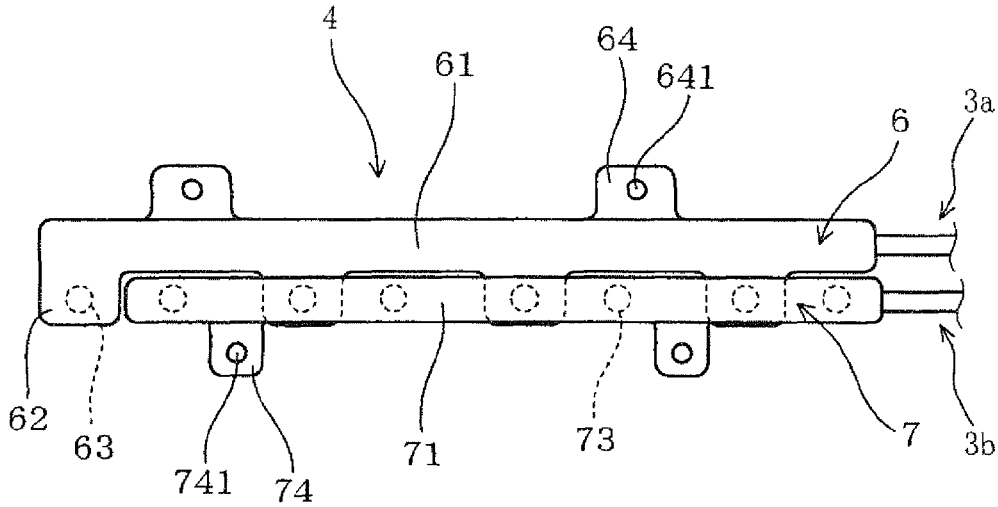
FIG. 4 is a top view showing the first fuel delivery pipe and the second fuel delivery pipe according to the first embodiment.
Figure 5:
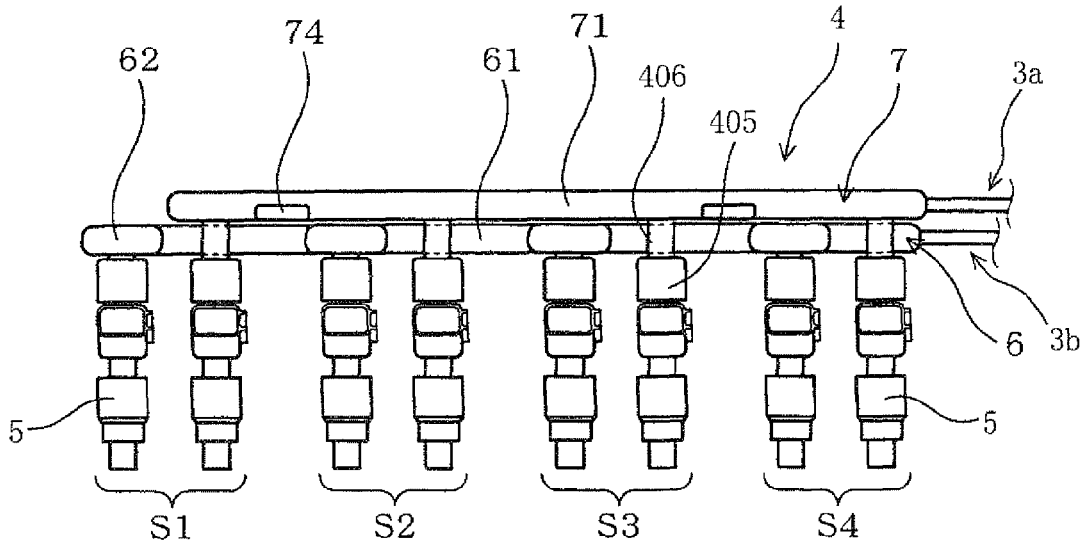
FIG. 5 is a lateral view showing the first fuel delivery pipe and the second fuel delivery pipe according to the first embodiment.

In the present embodiment, as shown in FIGS. 3 to 5, the fuel delivery pipe 4, which is for supplying fuel to each injector 5, has two fuel delivery pipes including a first fuel delivery pipe 6 and a second fuel delivery pipe 7. The first fuel delivery pipe 6 and the second fuel delivery pipe 7 can be combined such that all the injectors 5, which are provided to the first fuel delivery pipe 6 and the second fuel delivery pipe 7, are substantially linearly arranged on one line. Hereafter, the fuel delivery pipe 4 will be described in further detail.

As shown in FIG. 4, fuel is fed into a first path 3*a* and a second fuel path 3*b*, which are two passages separated from each other. As shown in FIG. 2, the first fuel delivery pipe 6 and the second fuel delivery pipe 7 respectively have a first fuel passage 42 and a second fuel passage 43. Fuel passes through the first path 3*a* and the second fuel path 3*b* and flows into the first fuel passage 42 and the second fuel passage 43. Thus, the fuel is accumulated in the first fuel delivery pipe 6 and the second fuel delivery pipe 7.

As shown in FIGS. 3, 4, the first fuel delivery pipe 6 includes a first body portion 61 and first projections 62. The first body portion 61 is in a substantially linear shape. Each of the first projections 62 protrude from the first body portion 61 perpendicularly to the axial directions of the injectors 5. The first projections 62 have lower surfaces, which respectively have four first fuel holes 63 for supplying fuel to the injectors 5. The four first fuel holes 63 are provided at locations to which the injectors 5 are respectively mounted. The first fuel delivery pipe 6 includes two first stationary portions 64 each projecting from the first body portion 61 to the opposite side of the first projections 62. Each of the first stationary portions 64 has a first stationary hole 641, which passes through the first stationary portion 64. The first fuel delivery pipe 6 is fixed by screwing bolts or the like through the first stationary holes 641 of the first stationary portions 64.

Referring to FIGS. 3, 4, the second fuel delivery pipe 7 has a second body portion 71, which is substantially in a linear shape. The second body portion 71 have lower surfaces, which respectively have four second fuel holes 73 for supplying fuel to the injectors 5. The four second fuel holes 73 are provided at locations to which the injectors 5 are respectively mounted. The second fuel delivery pipe 7 includes two second stationary portions 74 each projecting from the second body portion 71 to the opposite side of the first fuel delivery pipe 6. Each of the second stationary portion 74 has a second stationary hole 741, which passes through the second stationary portion 74. The second fuel delivery pipe 7 is fixed by screwing bolts or the like through the second stationary holes 741 of the second stationary portions 74.

As shown in FIGS. 3 to 5, the first fuel delivery pipe 6 and the second fuel delivery pipe 7 are stacked one another in a vertical position along the axial directions of the injectors 5, which are mounted to the first fuel delivery pipe 6 and the second fuel delivery pipe 7. In the present embodiment, the second body portion 71 of the second fuel delivery pipe 7 is located directly on the first projection 62 of the first fuel delivery pipe 6 at the upper side of the first fuel delivery pipe 6. Specifically, in FIG. 4, the first body portion 61 and the second body portion 71 are in parallel with each other when the first fuel delivery pipe 6 and the second fuel delivery pipe 7 are seen through from the upper side. The first projections 62 are arranged along the axial directions (pipe-axial directions) of the first body portion 61 and the second body portion 71. The first fuel hole 63 provided to the first projection 62 and the second fuel hole 73 provided to the second body portion 71 are alternately located and substantially linearly arranged in the pipe-axial direction.

As shown in FIGS. 3 to 5, each of the first fuel holes 63 and the second fuel holes 73 is provided with a mounting member 405 and a connecting member 406 each of which is substantially in a cylindrical shape and mounted with each injector 5. Each injector 5 is partially inserted into each mounting member 405 and mounted to the mounting member 405. In the present structure, each of the first fuel delivery pipe 6 and the second fuel delivery pipe 7 is provided with four injectors 5. The four injectors 5 are alternately arranged and substantially linearly located in the pipe-axial direction. As shown in FIG. 5, the lengths of the connecting members 406, which are mounted to the second fuel holes 73, are greater than the lengths of the connecting members 406, which are mounted to the first fuel holes 63, such that the locations of the tip ends of all the injectors 5 are substantially uniform.

As shown in FIGS. 3 to 5, the four injectors 5 mounted to the first fuel delivery pipe 6 respectively correspond to the first cylinder S1, the second cylinder S2, the third cylinder S3, and the fourth cylinder S4. Similarly, the four injectors 5 mounted to the second fuel delivery pipe 7 respectively correspond to the first cylinder S1, the second cylinder S2, the third cylinder S3, and the fourth cylinder S4. In the present embodiment, the injectors 5, which correspond to one side of the intake valves 23 in each cylinder S, are mounted to the first fuel delivery pipe 6, and the injectors 5, which correspond to the other side of the intake valves 23 in each cylinder S are mounted to the second fuel delivery pipe 7.

Next, an operation effect of the fuel delivery pipe 4 according to the present embodiment will be described. The fuel delivery pipe 4 according to the present embodiment is used for the engine 1, in which the two injectors 5 are provided respectively to the two intake valves 23 and the two intake valves 23 in each cylinder S. The fuel delivery pipe 4 is constructed of the first fuel delivery pipe 6 and the second fuel delivery pipe 7. Each injector 5, which corresponds to the one of the two intake valves 23 in each cylinder S, is mounted to the first fuel delivery pipe 6. Each injector 5, which corresponds to the other of the two intake valves 23 in each cylinder S, is mounted to the second fuel delivery pipe 7.

In the present embodiment, the fuel supply pipe device includes the first and second fuel delivery pipes 6, 7. Therefore, the number of the injectors 5, which are mounted to each of the two fuel delivery pipes 6, 7, can be reduced to half, compared with a structure in which all the injectors 5 are mounted to one fuel delivery pipe. Therefore, the injector 5 can be easily mounted to the fuel delivery pipe 4. In addition, the relative positions among the engine 1, the injectors 5 and the fuel delivery pipe 4 can be easily determined. For example, two adjacent injectors 5, which correspond to two adjacent cylinders S, are close to each other when being mounted to the engine. According to the present embodiment, two adjacent injectors 5 corresponding to two adjacent cylinders S need not be mounted to the same fuel delivery pipe. In the present structure, one of two adjacent injectors 5 is mounted to one of the two fuel delivery pipes 6, 7, and the other of the two adjacent injectors 5 is mounted to the other of the two fuel delivery pipes 6, 7. Therefore, the injectors 5 can be easily mounted to the fuel delivery pipes 6, 7. Further, in the present structure, for example, electric wiring to the injectors 5 can be performed separately for each of the fuel delivery pipes. Therefore, defective work such as faulty wiring to two adjacent injectors 5, which correspond to two adjacent cylinders S, can be reduced.

Furthermore, the number of injectors 5 mounted to each fuel delivery pipe can be reduced to half. Therefore, load exerted to each fuel delivery pipe can be reduced. Thus, mountability of the fuel delivery pipe 4 to the engine 1 can be enhanced. Furthermore, the number of injectors 5 mounted to each fuel delivery pipe can be reduced to half, and consequently pulsation caused in fuel supplied from each fuel delivery pipe to the injectors 5 can be reduced. In the present structure, fuel can be stably supplied from the fuel delivery pipe 4 to the injectors 5, and thereby fuel can be accurately injected from the injectors 5.

Furthermore, in the present structure, the fuel delivery pipe is divided into two components, and thereby entire fuel delivery pipe need not be exchanged when, for example, one of the injectors 5 causes a malfunction. That is, in a case where one injector 5 causes a malfunction, it suffices to exchange either the first fuel delivery pipe 6 or the second fuel delivery pipe 7, which is mounted with the one injector 5 causing the malfunction. Therefore, in the present structure, the fuel delivery pipe 4 and the injectors 5 can be easily exchanged in a case where one injector 5 causes a malfunction.

According to the present embodiment, the first fuel delivery pipe 6 and the second fuel delivery pipe 7 are configured to be stacked one another. Therefore, the fuel delivery pipe 4 can be entirely downsized by stacking the first fuel delivery pipe 6 and the second fuel delivery pipe 7 one another. Thus, according to the present embodiment, the fuel delivery pipe 4 can be easily mounted with the injectors 5. In addition, the injectors 5 mounted to the fuel delivery pipe 4 can be easily exchanged. Furthermore, the fuel delivery pipe 4 can be easily mounted to the engine 1 and easily exchanged.

Second Embodiment

Figure 6:
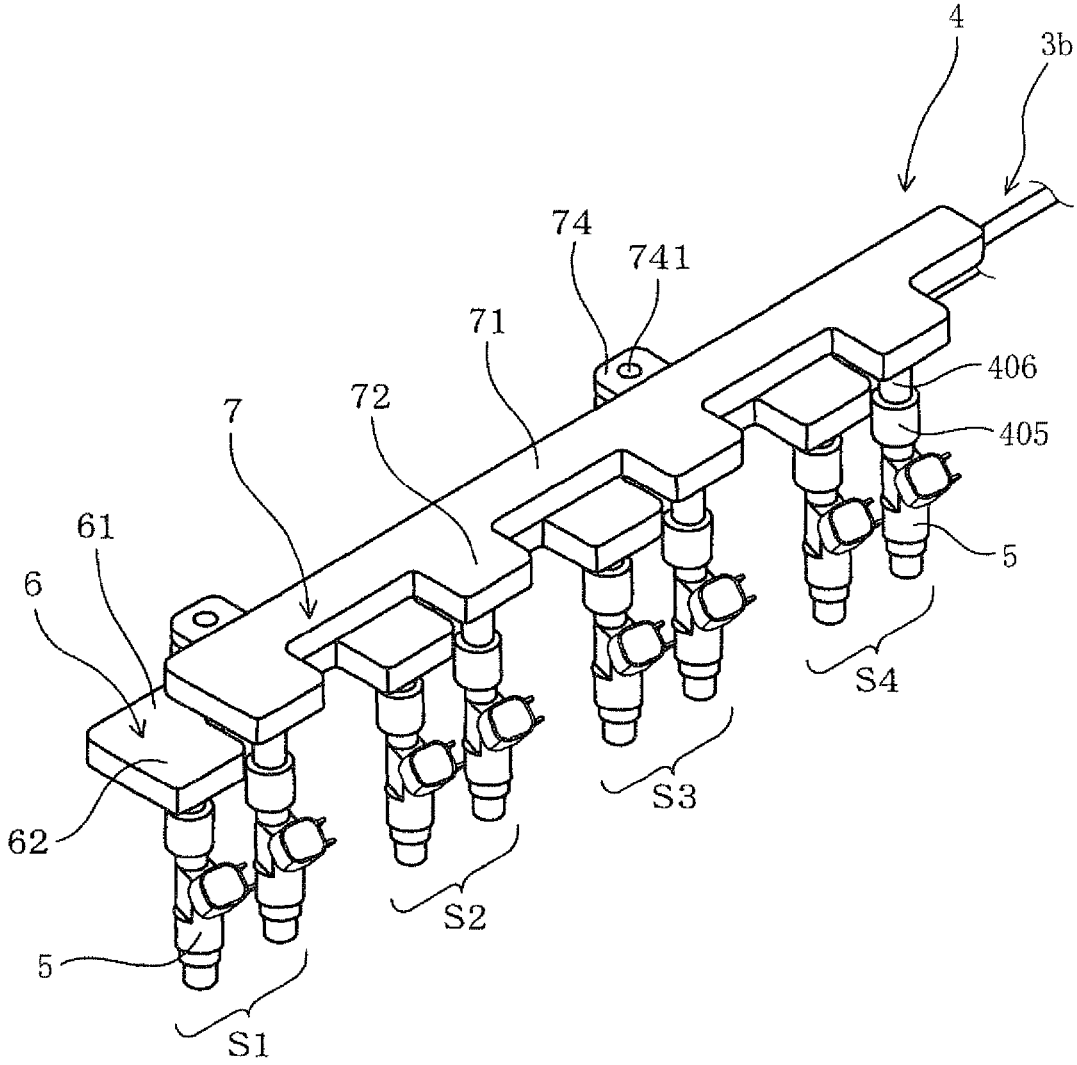
FIG. 6 is a perspective view showing a first fuel delivery pipe and a second fuel delivery pipe according to a second embodiment.
Figure 7:
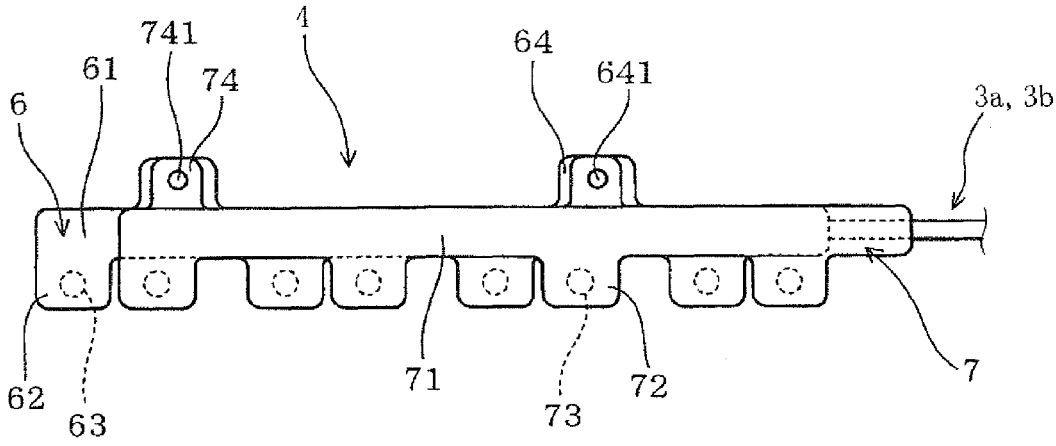
FIG. 7 is a top view showing the first fuel delivery pipe and the second fuel delivery pipe according to the second embodiment.
Figure 8:
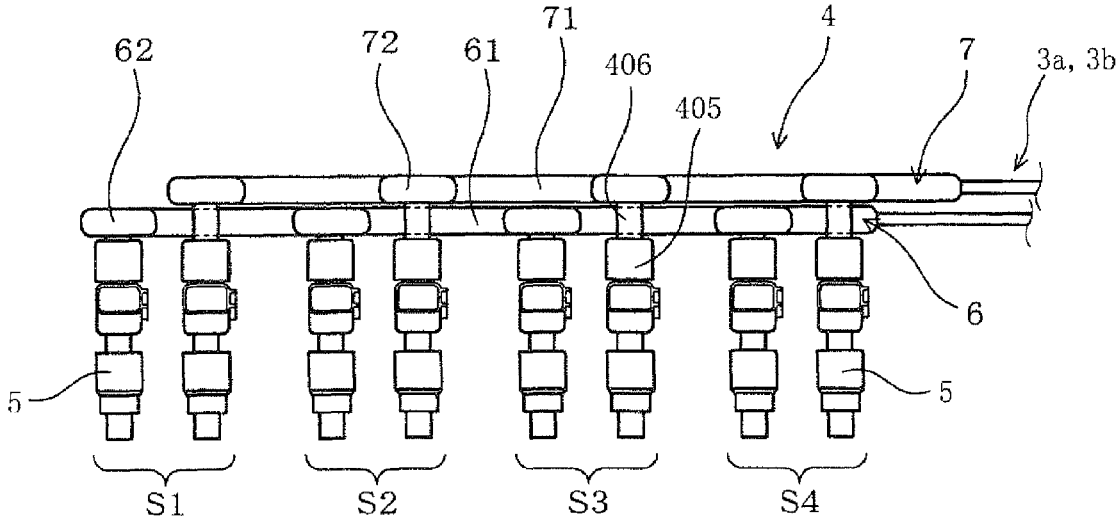
FIG. 8 is a lateral view showing the first fuel delivery pipe and the second fuel delivery pipe according to the second embodiment.

In the present second embodiment, as shown in FIGS. 6 to 8, the fuel delivery pipe 4 including the first fuel delivery pipe 6 and the second fuel delivery pipe 7 has a different structure from that in the first embodiment. According to the present second embodiment, as shown in FIGS. 6, 7, the first fuel delivery pipe 6 includes the first body portion 61 and the first projections 62. The first body portion 61 is in a substantially linear shape. The first projections 62 protrude from the first body portion 61 perpendicularly to the axial directions of the injectors 5. The first projections 62 have lower surfaces, which respectively have four first fuel holes 63 for supplying fuel to the injectors 5. The four first fuel holes 63 are provided at locations to which the injectors 5 are respectively mounted. The first fuel delivery pipe 6 includes two first stationary portions 64 each projecting from the first body portion 61 to the opposite side of the first projections 62. Each of the first stationary portions 64 has the first stationary hole 641, which passes through the first stationary portion 64.

As shown in FIGS. 6, 7, the second fuel delivery pipe 7 includes the second body portion 71 and second projections 72. The second body portion 71 is in a substantially linear shape. The second projections 72 protrude from the second body portion 71 perpendicularly to the axial directions of the injectors 5. The second projections 72 have lower surfaces, which respectively have the four second fuel holes 73 for supplying fuel to the injectors 5. The four second fuel holes 73 are provided at locations to which the injectors 5 are respectively mounted. The second fuel delivery pipe 7 includes two second stationary portions 74 each projecting from the second body portion 71 to the opposite side of the second projections 72. Each of the second stationary portions 74 has the second stationary hole 741, which passes through the second stationary portion 74.

As shown in FIGS. 6 to 8, the first fuel delivery pipe 6 and the second fuel delivery pipe 7 are stacked one another in the vertical position along the axial directions of the injectors 5, which are mounted to the first fuel delivery pipe 6 and the second fuel delivery pipe 7. In the present embodiment, the second projections 72 of the second fuel delivery pipe 7 are located at the upper side of the first projections 62 of the first fuel delivery pipe 6. Specifically, in FIG. 7, the first body portion 61 and the second body portion 71 are substantially on the same axis when the first fuel delivery pipe 6 and the second fuel delivery pipe 7 are seen through from the upper side. The first projection 62 and the second projection 72 are alternately located along the pipe-axial direction. The first fuel hole 63 provided to the first projection 62 and the second fuel hole 73 provided to the second projection 72 are alternately located and substantially linearly arranged in the pipe-axial direction.

As shown in FIGS. 6 to 8, each of the first fuel holes 63 and the second fuel holes 73 is provided with each injector 5 via the mounting member 405 and the connecting member 406. In the present structure, each of the first fuel delivery pipe 6 and the second fuel delivery pipe 7 is provided with four injectors 5, which are alternately arranged and located substantially linearly in the pipe-axial direction, similarly to the first embodiment. The four injectors 5 mounted to the first fuel holes 63 of the first fuel delivery pipe 6 respectively correspond to the first to fourth cylinders S1 to S4. The four injectors 5 mounted to the second fuel holes 73 of the second fuel delivery pipe 7 also respectively correspond to the first to fourth cylinders S1 to S4. Specifically, in FIG. 7, the first stationary portions 64 and the second stationary portions 74 are located at the same side when the first fuel delivery pipe 6 and the second fuel delivery pipe 7 are seen through from the upper side. In addition, the first stationary holes 641 of the first stationary portions 64 and the second stationary holes 741 of the second stationary portions 74 are located at the same side. According to the present embodiment, the first fuel delivery pipe 6 and the second fuel delivery pipe 7 are fixed by screwing bolts or the like respectively through the first stationary holes 641 and the second stationary holes 741 at the locations where the first stationary holes 641 and the second stationary holes 741 respectively overlap one another. In the present structure, the first fuel delivery pipe 6 and the second fuel delivery pipe 7 are fixed at the common locations. The structure of the fuel delivery pipe other than the above-described one feature of the present embodiment is substantially equivalent to that of the first embodiment.

According to the present embodiment, the first fuel delivery pipe 6 and the second fuel delivery pipe 7 are configured to be stacked one another, similarly to the first embodiment. Therefore, the fuel delivery pipe 4 can be entirely downsized by stacking the first fuel delivery pipe 6 and the second fuel delivery pipe 7 one another. In the present structure, the first fuel delivery pipe 6 and the second fuel delivery pipe 7 are fixed via the same stationary portions at the common locations. Therefore, the locations of the first fuel delivery pipe 6 and the second fuel delivery pipe 7 can be easily determined, and thereby the first fuel delivery pipe 6 and the second fuel delivery pipe 7 can be easily mounted and fixed. The structure and operation effect of the fuel delivery pipe other than the above-described one feature is substantially equivalent to that of the first embodiment.

Third Embodiment

Figure 9:
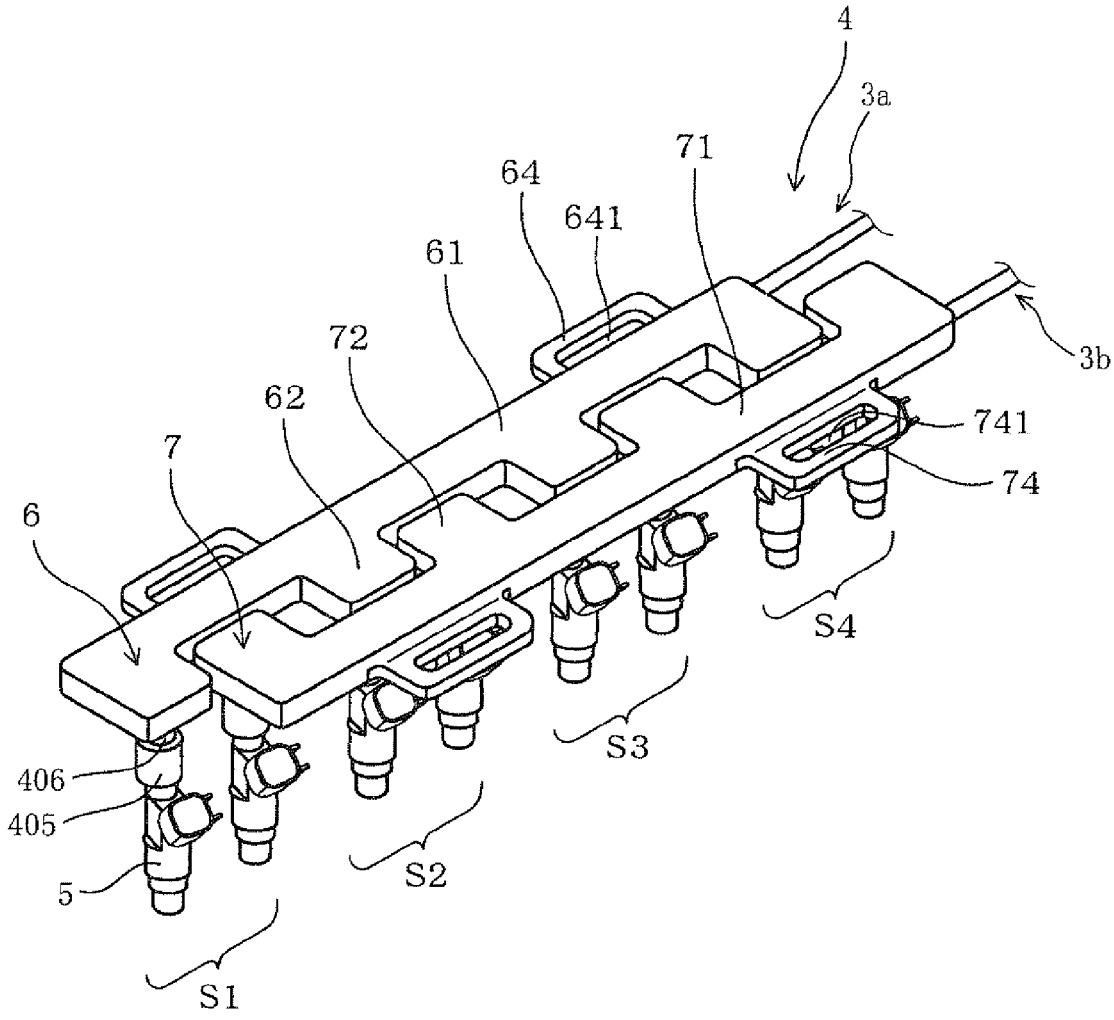
FIG. 9 is a perspective view showing a first fuel delivery pipe and a second fuel delivery pipe according to a third embodiment.
Figure 10:
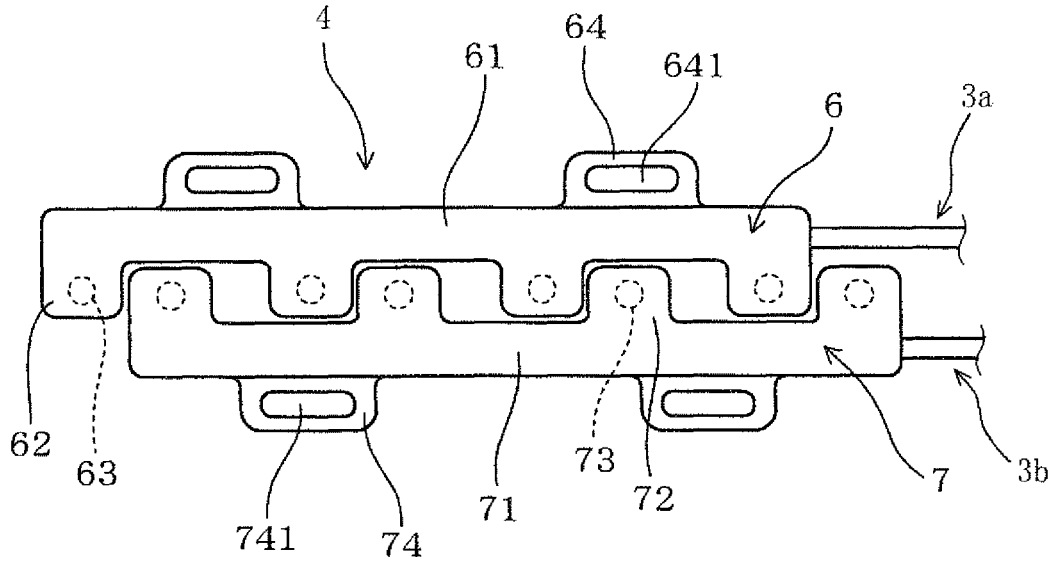
FIG. 10 is a top view showing the first fuel delivery pipe and the second fuel delivery pipe according to the third embodiment.
Figure 11:
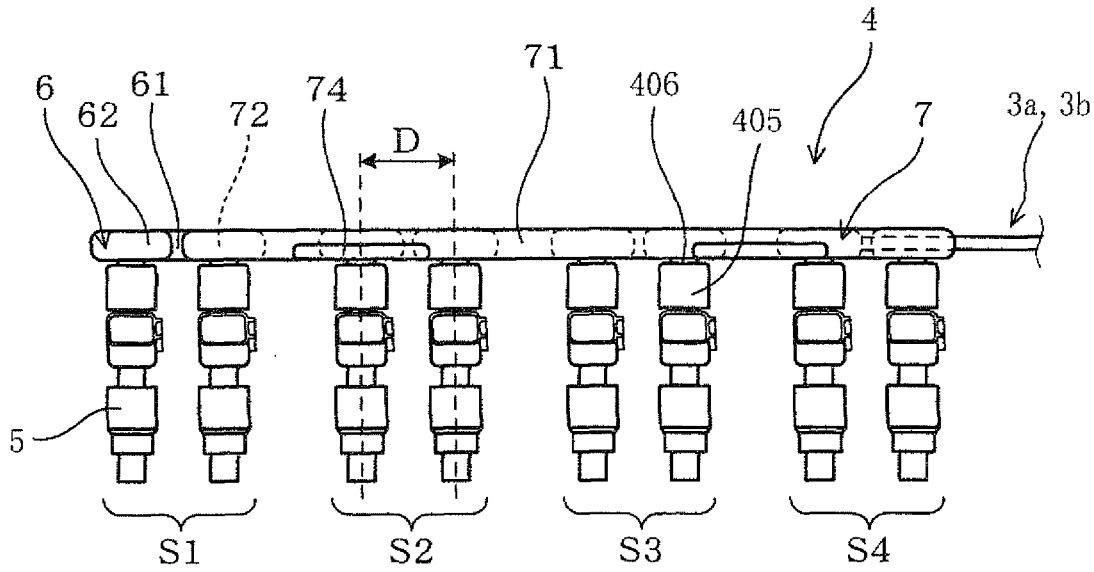
FIG. 11 is a lateral view showing the first fuel delivery pipe and the second fuel delivery pipe according to the third embodiment.

In the present second embodiment, as shown in FIGS. 9 to 11, the fuel delivery pipe 4 including the first fuel delivery pipe 6 and the second fuel delivery pipe 7 has a different structure from that in the above embodiments. According to the present third embodiment, as shown in FIGS. 9, 10, the first fuel delivery pipe 6 includes the first body portion 61 and the first projections 62. The first body portion 61 is in a substantially linear shape. The first projections 62 protrude from the first body portion 61 perpendicularly to the axial directions of the injectors 5. The first projections 62 have lower surfaces, which respectively have four first fuel holes 63 for supplying fuel to the injectors 5. The four first fuel holes 63 are provided at locations to which the injectors 5 are respectively mounted. The first fuel delivery pipe 6 includes two first stationary portions 64 each projecting from the first body portion 61 to the opposite side of the first projections 62. Each of the first stationary portions 64 has the first stationary hole 641, which passes through the first stationary portion 64. The first fuel delivery pipe 6 is fixed by screwing bolts or the like through the first stationary holes 641 of the first stationary portions 64.

As shown in FIGS. 9, 10, the second fuel delivery pipe 7 includes the second body portion 71 and the second projections 72. The second body portion 71 is in a substantially linear shape. The second projections 72 protrude from the second body portion 71 perpendicularly to the axial directions of the injectors 5. The second projections 72 have lower surfaces, which respectively have four second fuel holes 73 for supplying fuel to the injectors 5. The four second fuel holes 73 are provided at locations to which the injectors 5 are respectively mounted. The second fuel delivery pipe 7 includes two second stationary portions 74 each projecting from the second body portion 71 to the opposite side of the second projections 72. Each of the second stationary portions 74 has the second stationary hole 7411 which passes through the second stationary portion 74. The second fuel delivery pipe 7 is fixed by screwing bolts or the like through the second stationary holes 741 of the second stationary portions 74.

As shown in FIGS. 9 to 11, the first fuel delivery pipe 6 and the second fuel delivery pipe 7 are located on a plane, which is perpendicular to the axial directions of the injectors 5, which are mounted to the first fuel delivery pipe 6 and the second fuel delivery pipe 7. In the present embodiment, the first projections 62 of the first fuel delivery pipe 6 and the second projections 72 of the second fuel delivery pipe 7 are alternately located substantially linearly in the same plane. Specifically, in FIG. 10, the first body portion 61 and the second body portion 71 are substantially in parallel with each other when the first fuel delivery pipe 6 and the second fuel delivery pipe 7 are seen from the upper side. The first projection 62 and the second projection 72 are alternately located between the first body portion 61 and the second body portion 71 and arranged along the pipe-axial direction. The first fuel hole 63 provided to the first projection 62 and the second fuel hole 73 provided to the second projection 72 are alternately located and substantially linearly arranged in the pipe-axial direction.

As shown in FIGS. 9 to 11, each of the first fuel holes 63 and the second fuel holes 73 is provided with each injector 5 via the mounting member 405 and the connecting member 406. In the present structure, each of the first fuel delivery pipe 6 and the second fuel delivery pipe 7 is provided with four injectors 5, which are alternately arranged and located substantially linearly in the pipe-axial direction, similarly to the above embodiments. The four injectors 5 mounted to the first fuel holes 63 of the first fuel delivery pipe 6 respectively correspond to the first to fourth cylinders S1 to S4. The four injectors 5 mounted to the second fuel holes 73 of the second fuel delivery pipe 7 also respectively correspond to the first to fourth cylinders S1 to S4.

According to the present embodiment, as shown in FIG. 11, the distance D between adjacent two of the injectors 5, which corresponds to one cylinder S, can be adjusted by moving the first fuel delivery pipe 6 and the second fuel delivery pipe 7 relatively to each other. Specifically, according to the present embodiment, the distance between the two injectors 5, which corresponds to the one cylinder S, can be adjusted by moving at least one of the first fuel delivery pipe 6 and the second fuel delivery pipe 7 in the direction along which the injectors 5 are arranged. Each of the first stationary hole 641 of the first stationary portion 64 and the second stationary hole 741 of the second stationary portion 74 is elongated in the direction along which the injectors 5 are arranged. Thereby, the stationary portions, via which the first fuel delivery pipe 6 and the second fuel delivery pipe 7 are fixed, need not be modified when the first fuel delivery pipe 6 and the second fuel delivery pipe 7 are relatively moved in the direction along which the injectors 5 are arranged. The structure of the fuel delivery pipe other than the one feature of the present embodiment is substantially equivalent to that of the above embodiments.

In a twin injection engine, two fuel injection valves are provided respectively to two intake valves in each cylinder. In such a twin injection engine, for example, when the distance between adjacent two intake valves differ, intake air flow changes, and consequently fuel sprays injected from the fuel injection valves also change. Therefore, the distance between the adjacent fuel injection valves needs to be arbitrary adjusted so as to control the fuel sprays in an optimal state. According to the present embodiment, the distance between adjacent fuel injection valves provided to the fuel delivery pipes can be arbitrarily adjusted. Thus, the fuel delivery pipes can be applied to various internal combustion engines in which the distance between adjacent intake valves is different, without a large change in design.

According to the present embodiment, the first fuel delivery pipe 6 and the second fuel delivery pipe 7 are configured to be located in the same plane. In the present structure, the first fuel delivery pipe 6 and the second fuel delivery pipe 7 can be easily mounted and fixed by locating the first fuel delivery pipe 6 and the second fuel delivery pipe 7 on the same plane. In addition, the engine, which is provided with the first fuel delivery pipe 6 and the second fuel delivery pipe 7, can be reduced.

According to the present embodiment, the distance D between adjacent two of the injectors 5, which correspond to one cylinder S, can be adjusted by moving the first fuel delivery pipe 6 and the second fuel delivery pipe 7 relatively to each other. According to the present structure, even when the distances between adjacent two of the injectors 5 vary in different engines 1, the fuel delivery pipe 4 can be applied to the engines 1 without large modification of the design of the fuel delivery pipe, since the distance D between the adjacent injectors 5 of the fuel delivery pipe 4 can be arbitrary adjusted. Thus, dissimilarly to a conventional fuel delivery pipe, the fuel delivery pipe 4 according to the present embodiment need not be separately designed and manufactured for different engines 1. In addition, flow of intake air, flow of fuel injected from the injectors 5, and the like can be easily modified to be in an optimal state by adjusting the distance D between two injectors 5, which corresponds to one cylinder S. The present structure, in which the distance D between the two injectors 5 is adjustable, can be also applied to the fuel delivery pipe 4 according to the first and second embodiments. The structure and operation effect of the fuel delivery pipe other than the above-described one feature is substantially equivalent to that of the above embodiments.

Fourth Embodiment

Figure 12:
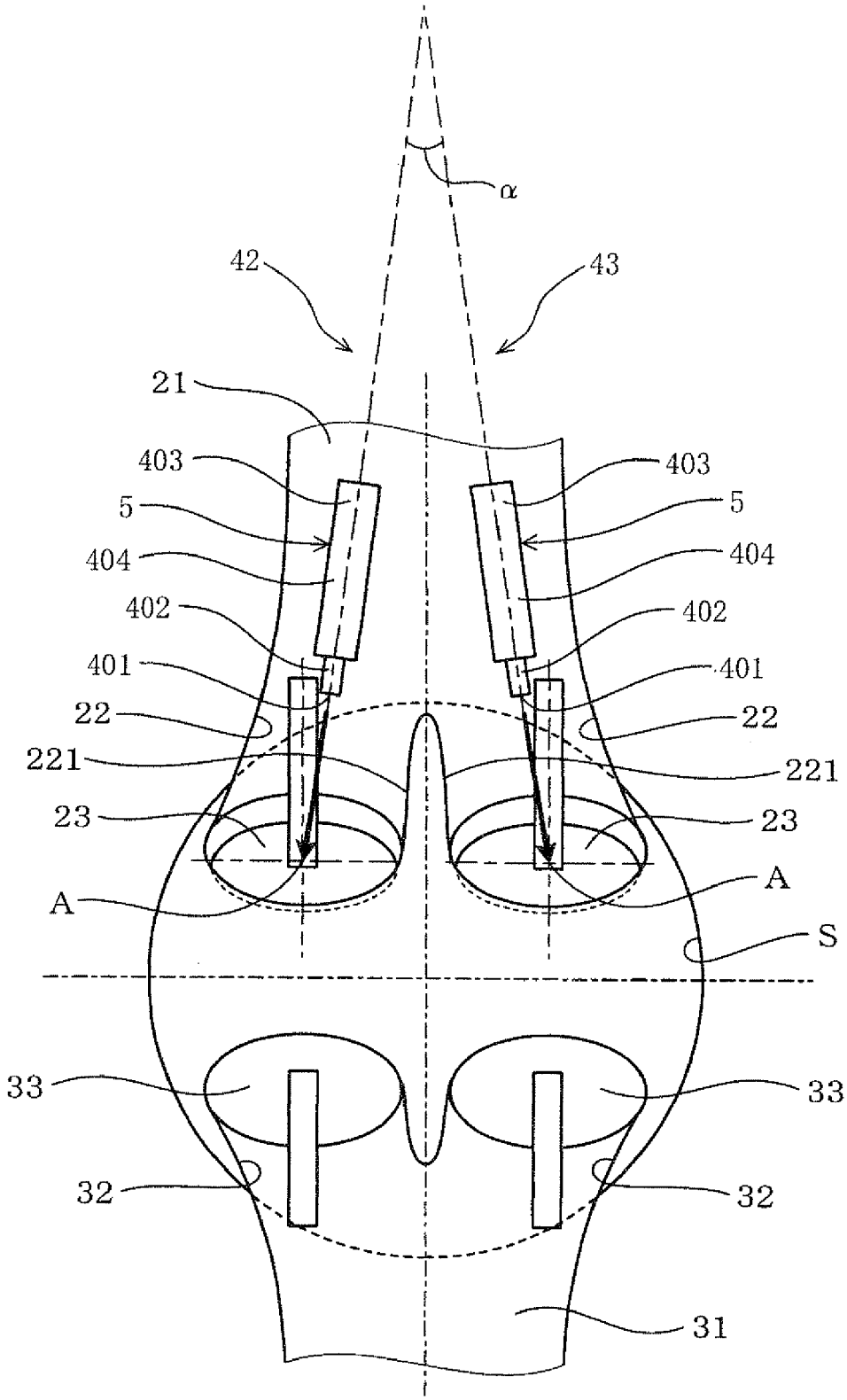
FIG. 12 is a schematic top view showing intake valves and injectors when being viewed along the axial direction of the cylinder according to a fourth embodiment.
Figure 13:
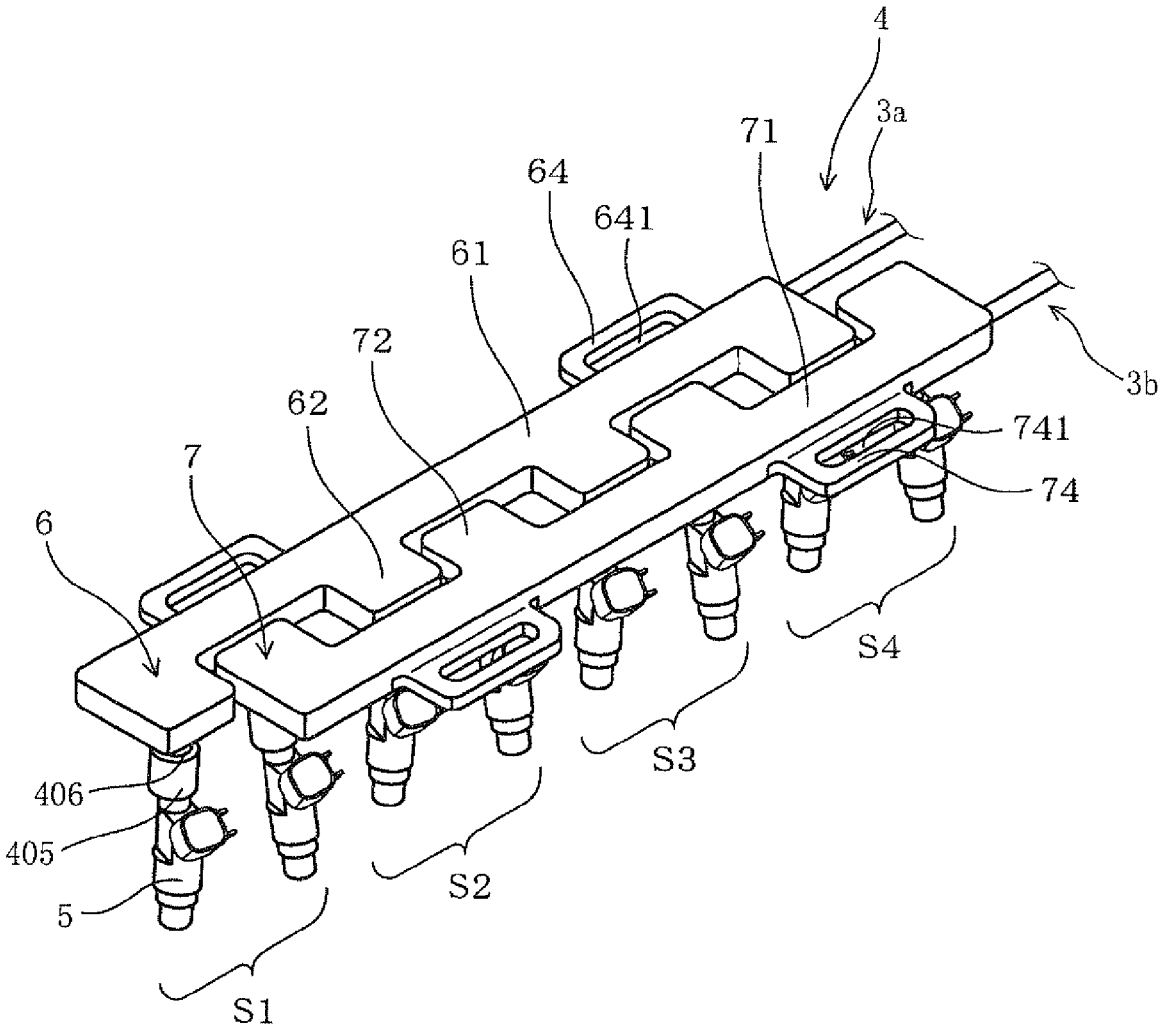
FIG. 13 is a perspective view showing a first fuel delivery pipe and a second fuel delivery pipe according to the fourth embodiment.
Figure 14:
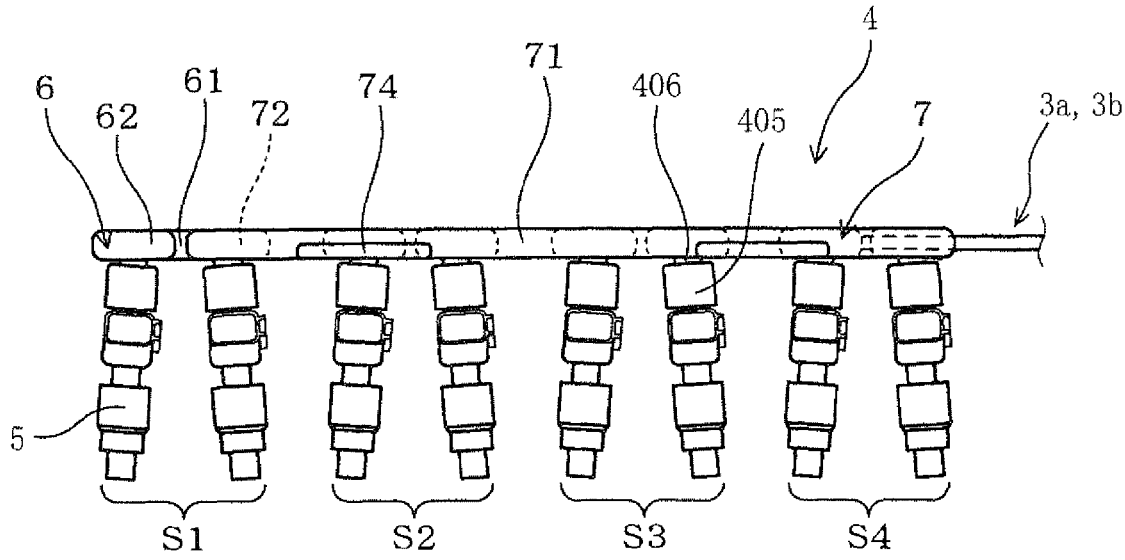
FIG. 14 is a lateral view showing the first fuel delivery pipe and the second fuel delivery pipe according to the fourth embodiment.

In the present fourth embodiment, as shown in FIGS. 12 to 14, the injectors 5 provided to the fuel delivery pipe 4 including the first fuel delivery pipe 6 and the second fuel delivery pipe 7 have different structures from those in the above embodiments. As shown in FIG. 12, two injectors 5, which correspond to two intake valves 23 in each cylinder S, are inclined relative to each other and are at different angles. Specifically, the axial directions of the injectors 5 are directed to the center A of the intake valve 23 so as to avoid adhesion of fuel, which is injected from the injectors 5, to inner walls 221 of the intake ports 22. Two injectors 5 are arranged substantially in a V-shape to outward extend at one end. Two injectors S are approximately at an angle $\alpha$ of 20° therebetween. The angle between the two injectors 5 may be in a range between 0.5° and 30°.

As shown in FIGS. 13, 14, the first fuel delivery pipe 6 is mounted with the injectors 5 inclined to the left side and directed to one axial direction, and the second fuel delivery pipe 7 is mounted with the injectors 5 inclined to the right side and directed to another axial direction. The structure of the fuel delivery pipe other than the one feature of the present embodiment is substantially equivalent to that of the third embodiment.

According to the present embodiment, the injectors 5 directed to the different axial directions are separately and respectively mounted to the first fuel delivery pipe 6 and the second fuel delivery pipe 7. That is, the injectors 5 directed to the same one axial direction are mounted to one of the first fuel delivery pipe 6 and the second fuel delivery pipe 7. In addition, the injectors 5 directed to the same other axial direction are mounted to the other of the first fuel delivery pipe 6 and the second fuel delivery pipe 7. According to the present structure, the two injectors 5, which correspond to one cylinder S, are inclined relative to each other, and thereby the two injectors 5 can significantly produce the effect of injecting fuel in different directions. In addition, the injectors 5 can be easily and efficiently mounted to the fuel delivery pipe and the engine. The structure and operation effect of the fuel delivery pipe other than the above-described one feature is substantially equivalent to that of the third embodiment.

In the first to fourth embodiments, the number of the fuel delivery pipes may be three or more.

Fifth Embodiment

The fifth embodiment will be described as follows. A fuel injection device according to the present fifth embodiment is applied to a reciprocal spark-ignition internal combustion engine, for example.

Figure 15:
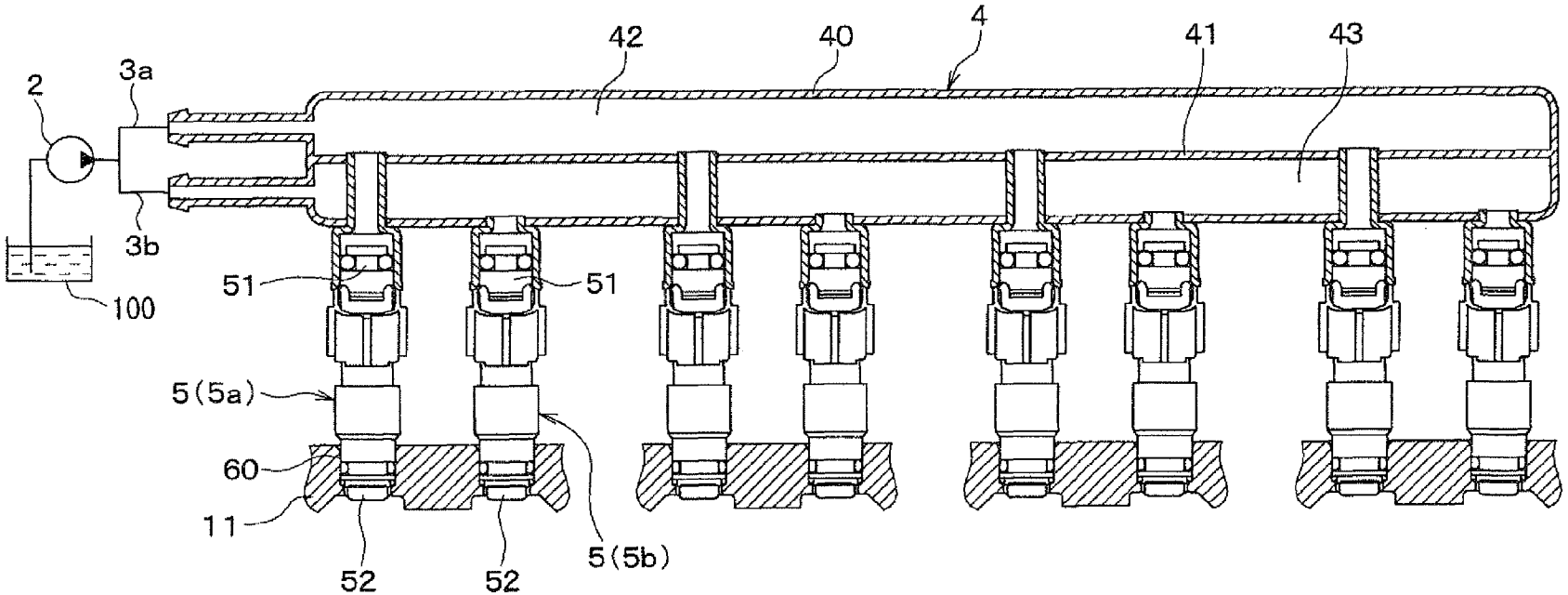
FIG. 15 is a lateral sectional view showing a fuel injection device according to a fifth embodiment.
Figure 16:
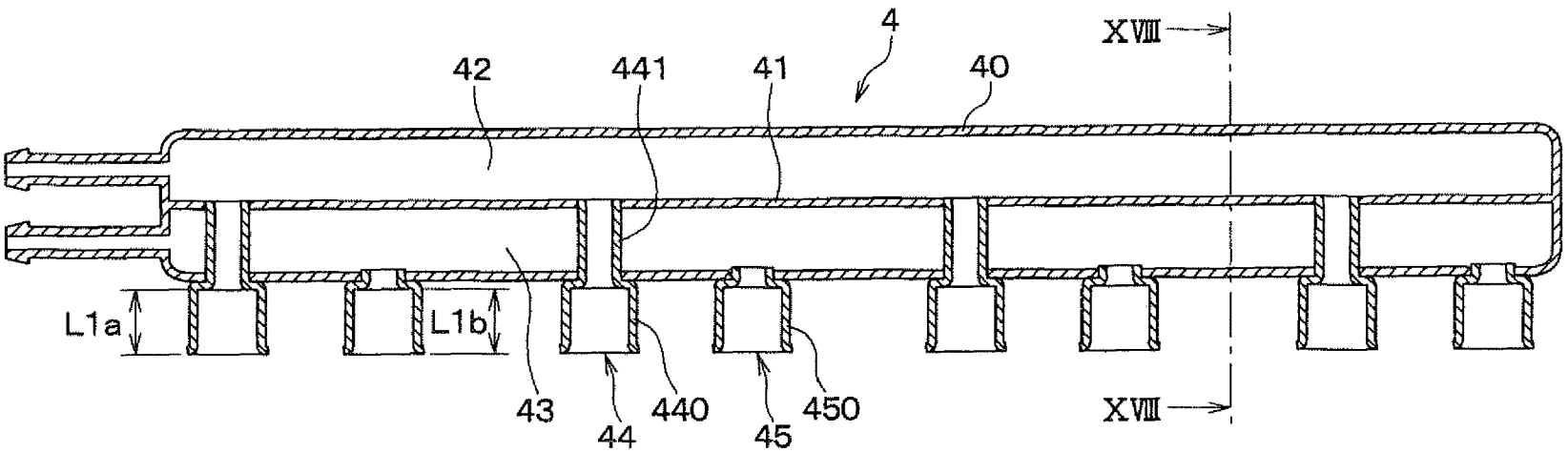
FIG. 16 is a lateral sectional view showing a fuel delivery pipe of the fuel injection device according to the fifth embodiment.
Figure 17:
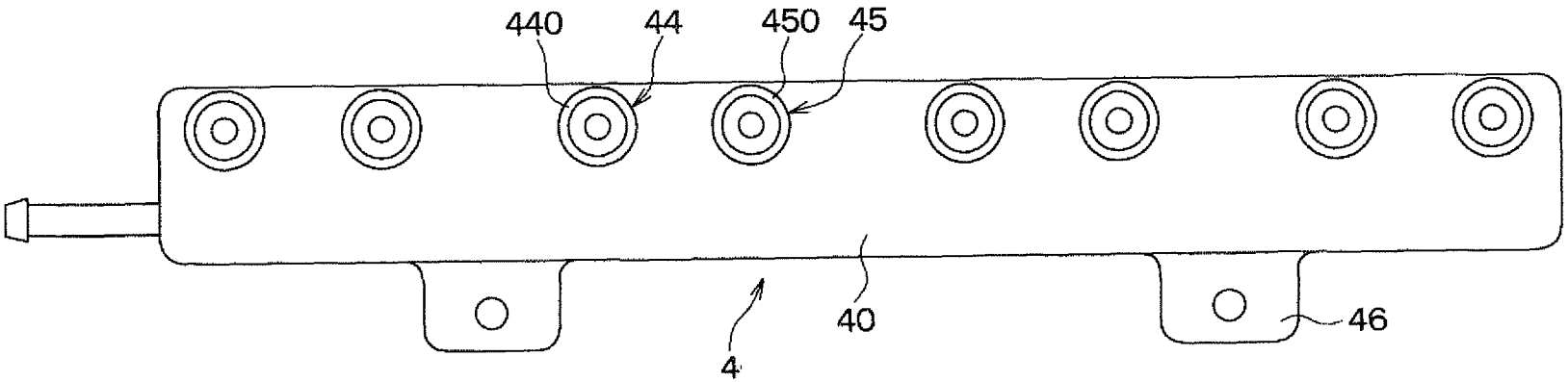
FIG. 17 is a bottom view showing the fuel delivery pipe according to the fifth embodiment.
Figure 18:
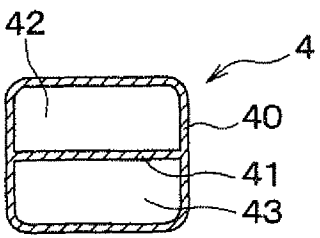
FIG. 18 is a sectional view taken along the line XVIII-XVIII in FIG. 16.

As shown in FIG. 15, a fuel pump 2 draws fuel from a fuel tank 100 and pressurizes the fuel. The fuel pressurized by the fuel pump 2 is fed through the first and second fuel paths 3*a*, 3*b*, which are two passages branched from one passage, to the fuel delivery pipe 4, and the fuel is accumulated in the fuel delivery pipe 4. The fuel delivery pipe 4 is connected with multiple injectors 5. Fuel is supplied from the fuel delivery pipe 4 and injected from the injectors 5 in the internal combustion engine. Each of the injectors 5 has a fuel inlet portion 51 having an inlet hole, which is supplied with fuel from the fuel delivery pipe 4, at one end. Each injector 5 has a fuel outlet portion 52 having a nozzle, which is configured to open to inject fuel, at the other end. The fuel outlet portion 52 of the injector 5 is inserted into an injector insertion hole 60, which is provided in the cylinder head 11 of the internal combustion engine. The injector 5 injects fuel through the fuel outlet portion 52 into an intake passage (not shown) provided to the cylinder head 11. The axes of all the injectors 5 are substantially in parallel with each other. All the injectors 5 are substantially arranged on a line along a crankshaft of the engine. That is, all the injectors 5 are linearly arranged substantially along a direction of the cylinder bank.

In the resent embodiment, two injectors 5 are provided in each cylinder, and the internal combustion engine is an inline 4-cylinder engine and provided with eight injectors 5. A common cylinder injector group includes two injectors 5 provided to each common cylinder for injecting fuel into the common cylinder. The common cylinder injector group includes a first injector 5*a* at one side and a second injector 5*b* at the other side. The first injector 5*a* and the second injector 5*b* of the common cylinder injector group are synchronously manipulated.

As shown in FIGS. 15 to 18, the fuel delivery pipe 4 includes a main body 40, which is substantially in a rectangular parallelepiped shape and has an inner space for storing fuel. The main body 40 has a plate-shaped partition wall 41, which partitions the inner space inside the main body 40 into a first compartment (first fuel passage) 42 and a second compartment (second fuel passage) 43. The fuel delivery pipe 4 has compartments, which is the same as the injectors 5 in number for each cylinder. That is, in the present embodiment, two injectors are provided in each cylinder, and therefore the fuel delivery pipe 4 has two compartments including the first compartment 42 and the second compartment 43. The first compartment 42 and the second compartment 43 are substantially equivalent to each other in volume. The first compartment 42 is supplied with fuel from the fuel pump 2 through the first fuel path 3*a*. The second compartment 43 is supplied with fuel from the fuel pump 2 through the second fuel path 3*b*.

The fuel delivery pipe 4 includes a first injector mounting pipe 44 and a second injector mounting pipe 45. The first injector mounting pipe 44 guides fuel from the first compartment 42 to the first injector 5*a*. The second injector mounting pipe 45 guides fuel from the second compartment 43 to the second injector 5*b*. According to the present structure, the first injector 5*a* and the second injector 5*b* are connected to separate compartments in each common cylinder injector group. The first injector mounting pipe 44 includes a first cup portion 440 and a fuel pipe portion 441. The first cup portion 440 is substantially in a tubular shape and inserted with the fuel inlet portion 51 of the injector 5. The fuel pipe portion 441 is substantially in a tubular shape and smaller in diameter than the first cup portion 440. The first injector mounting pipe 44 passes through the second compartment 43. Specifically, the fuel pipe portion 441 is located in the second compartment 43, and the first cup portion 440 protrudes from the main body 40. The second injector mounting pipe 45 includes a second cup portion 450, which is substantially in a tubular shape and inserted with the fuel inlet portion 51 of the injector 5. The second cup portion 450 protrudes from the main body 40. The first cup portion 440 is inserted with the fuel inlet portion 51 of the injector 5 by a length L1*a*. The second cup portion 450 is inserted with the fuel inlet portion 51 by a length L1*b*. The length L1*a* is substantially the same as the length L1*b*. The opening ends of the first cup portion 440 and the second cup portion 450 are substantially at the same position in the direction in which the fuel inlet portion 51 of the injector 5 is inserted. The main body 40 is integrated with two brackets 46. The fuel delivery pipe 4 is fixed to the cylinder head 11 by screwing bolts (not shown) through the two brackets 46.

The fuel delivery pipe 4 is formed from a ferrous material, an aluminum alloy, a resin, or the like. The fuel delivery pipe 4 is manufactured by plastic forming such as press forming, or manufactured by welding, die-casting, or the like when being formed from a ferrous material or an aluminum alloy. Alternatively, the fuel delivery pipe 4 is molded when being formed from a resin, for example.

Next, a mounting process of the fuel delivery pipe 4 and the injectors 5 will be described. First, each fuel inlet portions 51 of each first injector 5*a* is inserted into each first cup portion 440, and each fuel inlet portion 51 of each second injector 5*b* is inserted into each second cup portion 450. Thus, the fuel delivery pipe 4 is integrated with all the eight injectors 5. Subsequently, each injector insertion hole 60 is inserted with corresponding one of the fuel outlet portions 52 of the injectors 5, which are integrated with the fuel delivery pipe 4. The fuel delivery pipe 4 is fixed to the cylinder head 11 using bolts (not shown). In the present manufacturing process, the axes of all the injectors S are substantially in parallel with each other, and thereby the fuel outlet portions 52 of all the injectors 5, which are integrated with the fuel delivery pipe 4, can be inserted into the injector insertion holes 60. Subsequently, the first fuel path 3*a* is connected to the first compartment 42 of the fuel delivery pipe 4, and the second fuel path 3*b* is connected to the second compartment 43 of the fuel delivery pipe 4.

Next, an operation of the fuel delivery pipe 4 and the injectors 5 will be described. When the engine is in operation, the fuel pump 2 draws fuel from the fuel tank 100 and press-feeds the fuel through the first and second fuel paths 3*a*, 3*b* to the fuel delivery pipe 4, and the fuel is accumulated in the fuel delivery pipe 4. The fuel accumulated in the fuel delivery pipe 4 is guided through the fuel inlet portions 51 to the injectors 5 and injected from the nozzles of the fuel outlet portions 52 into the internal combustion engine in response to opening of the injectors 5. The first injector 5*a* and the second injector 5*b* in the common cylinder injector group are synchronously manipulated, and therefore pulsation occurs at two locations in the fuel delivery pipe 4 in response to closing of both the first injector 5*a* and the second injector 5*b*. According to the present structure, the first injector 5*a* and the second injector 5*b* are connected to the separate compartments, and thereby two pulsations are caused in the separate compartment, which are isolated from each other. Therefore, amplification of the two pulsations caused by interference, i.e., resonance therebetween can be restricted, and thereby fuel injection quantity can be stabilized. In addition, according to the present embodiment, the fuel delivery pipe 4 has the main body 40 having the partition wall 41, which partitions the inner space into the first compartment 42 and the second compartment 43. In the present structure, the fuel delivery pipe 4 can be simplified and downsized compared with a structure in which the fuel delivery pipe 4 is constructed of two pipes and a communication pipe, for example.

Sixth Embodiment

The sixth embodiment will be described as follows. According to the present sixth embodiment, the structures of the first injector mounting pipe 44 and the second injector mounting pipe 45 are different from those in the fifth embodiment. The structure of the first injector 5*a* is also different from the structure of the second injector 5*b*. The structure of the fuel delivery pipe other than the above-described differences is substantially equivalent to that of the fifth embodiment.

Figure 19:
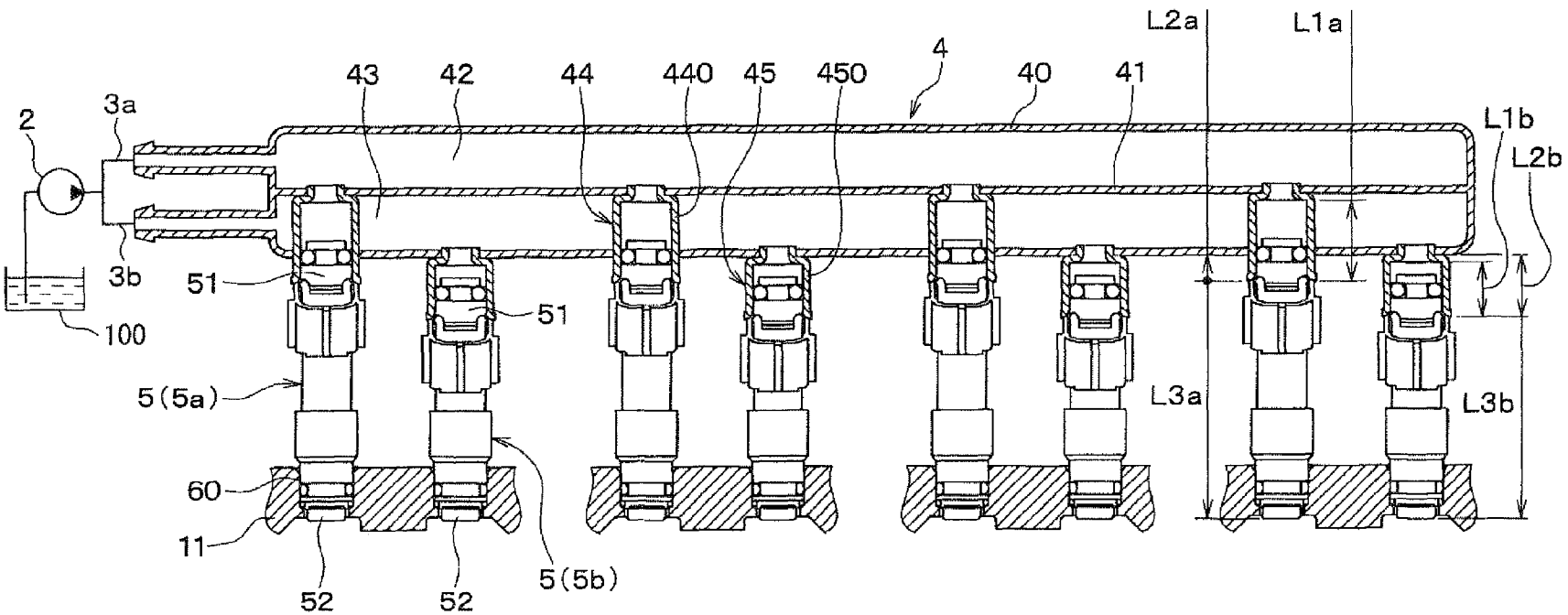
FIG. 19 is a lateral sectional view showing a fuel injection device according to a sixth embodiment.

As shown in FIG. 19, the length L1*a* of the first cup portion 440 of each first injector mounting pipe 44 is larger than the length L1*b* of the second cup portion 450 of each second injector mounting pipe 45 in the direction in which the fuel inlet portions 51 is inserted. The opening ends of the first cup portion 440 and the second cup portion 450 are different from each other in position in the direction in which the fuel inlet portion 51 of the injector 5 is inserted. More specifically, a length L2*a*, by which the first cup portion 440 protrudes from the main body 40, is smaller than a length L2*b*, by which the second cup portion 450 protrudes from the main body 40. Further, the fuel inlet portions 51 is inserted so as to make contact with the open end of each first cup portion 440, and the fuel inlet portion 51 is inserted so as to make contact with the open end of each second cup portion 450. In the present condition, a length L3*a*, by which the first injector 5*a* partially protrudes from the first cup portion 440, is larger than a length L3*b*, by which the second injector 5*b* partially protrudes from the second cup portion 450. In addition, the injectors 5 and the fuel delivery pipe 4 satisfy the following equation of L2*a*+L3*a*=L2*b*+L3*b*.

In the above manufacturing process, the injectors 5 may be incorrectly mounted to the fuel delivery pipe 4. For example, the second injector 5*b* may be wrongly mounted to the first injector mounting pipe 44, or the first injector 5*a* may be wrongly mounted to the second injector mounting pipe 45. In the present embodiment, the injectors 5 and the fuel delivery pipe 4 satisfy the following equation of L2*a*+L3*a*=L2*b*+L 3*b*, and thereby when the first and second injectors 5*a*, 5*b* are wrongly mounted, the positions of the ends of the fuel outlet portions 52 of the injectors 5 become non-uniform. Therefore, the injector 5, which is wrongly mounted, can be easily found, and thereby the injectors 5 can be restricted from being wrongly mounted.

Seventh Embodiment

According to the present seventh embodiment, the structure of the fuel delivery pipe 4 is different from that in the fifth embodiment. The structure other than the above-described difference is substantially equivalent to that of the fifth embodiment.

Figure 20:
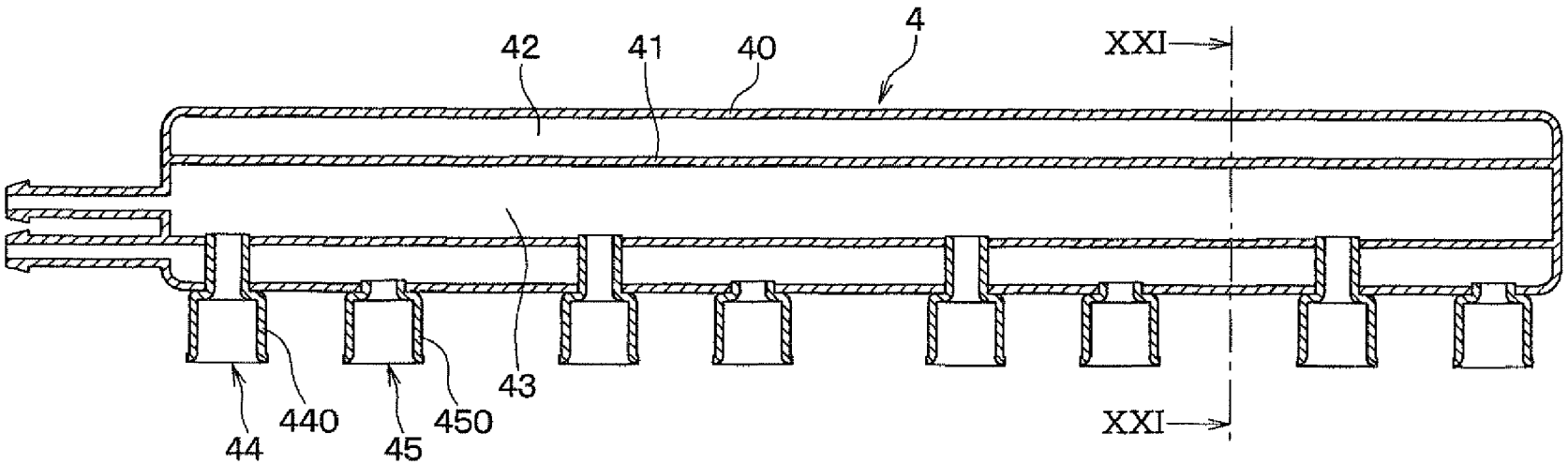
FIG. 20 is a lateral sectional view showing a fuel injection device according to a seventh embodiment.
Figure 21:
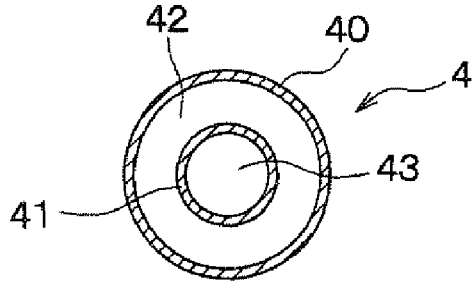
FIG. 21 is a sectional view taken along the line XXI-XXI in FIG. 20.
Figure 22:
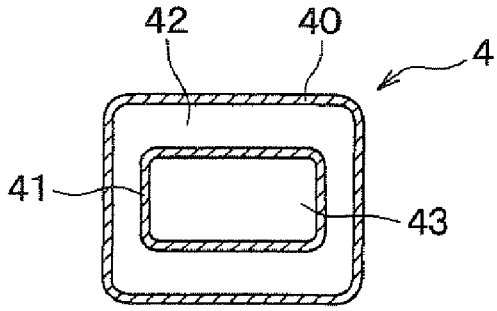
FIG. 22 is a sectional view showing a fuel delivery pipe according to a modification of the seventh embodiment.

As shown in FIGS. 20 to 21, the main body 40 of the fuel delivery pipe 4 is substantially in a tubular shape and has an inner space for accumulating fuel. The partition wall 41 is substantially in a tubular shape and partitions the inner space of the main body 40 into the first compartment 42 and the second compartment 43. In the present structure, the fuel delivery pipe 4 has a double pipe structure. According to the present embodiment, the fuel delivery pipe 4 can be also simplified and downsized. The main body 40 and the partition wall 41 may be in various tubular shapes in cross section. For example, as shown in FIG. 22, the main body 40 and the partition wall 41 may be substantially in rectangular tubular shapes.

Other Embodiment

In the above embodiments, the delivery pipe is applied to the internal combustion engine in which two injectors 5 are provided in each cylinder. Alternatively, the delivery pipe may be applied to an internal combustion engine in which three or more injectors 5 are provided in each cylinder. In that case, the fuel delivery pipe 4 also has the same number of compartments as the number of the injectors 5 for each cylinder, and each injector is separately connected to corresponding one of the compartments in the common cylinder injector group.

In the above embodiments, the term of perpendicular does not strictly mean the right angle (90°), and may include an error.

The injectors 5 may be non-linearly arranged on the engine.

The above structures of the embodiments may be combined as appropriate. Various modifications and alternations may be diversely made to the above embodiments without departing from the spirit of the present invention.

What is claimed is:

1. A fuel supply pipe device for an internal combustion engine, which has a plurality of cylinders each provided with a plurality of injectors, the fuel supply pipe device comprising:

a plurality of fuel passages, which are configured to receive fuel through a plurality of fuel paths and supply the fuel correspondingly to the plurality of injectors, wherein the plurality of fuel passages are respectively separated from one another, the plurality of fuel passages includes a first fuel passage, which is defined in a first delivery pipe and configured to receive fuel through a first fuel path of the plurality of fuel paths and supply the fuel to at least one of the plurality of injectors, the plurality of fuel passages includes a second fuel passage, which is defined in a second delivery pipe and configured to receive fuel through a second fuel path of the plurality of fuel paths and supply the fuel to the other of the plurality of injectors, and the first delivery pipe and the second delivery pipe are configured to be combined such that all of the plurality of injectors are substantially linearly arranged on a single line.

2. The fuel supply pipe device according to claim 1, wherein the first delivery pipe and the second delivery pipe are configured to be stacked on one another substantially in an axial direction of the plurality of injectors.

3. The fuel supply pipe device according to claim 2, wherein the first delivery pipe includes a first body portion, which is substantially in a linear shape, and at least one first projection each protruding from the first body portion substantially perpendicularly to the axial direction of the plurality of injectors, each of the at least one first projection is mounted with the at least one of the plurality of injectors, the second delivery pipe includes a second body portion, which is substantially in a linear shape, the second body portion is mounted with the other of the plurality of injectors, and the second body portion is configured to be located directly on the first delivery pipe.

4. The fuel supply pipe device according to claim 2, wherein the first delivery pipe includes a first body portion, which is substantially in a linear shape, and at least one first projection each protruding from the first body portion substantially perpendicularly to the axial direction of the plurality of injectors, each of the at least one first projection is mounted with the at least one injector, the second delivery pipe includes a second body portion, which is substantially in a linear shape, and at least one second projection each protruding from the second body portion substantially perpendicularly to the axial direction of the plurality of injectors, each of the at least one second projection is mounted with the other of the plurality of injectors, and the at least one second projection is configured to be located in the vicinity of the first delivery pipe in the axial direction of the plurality of injectors.

5. The fuel supply pipe device according to claim 1, wherein the first delivery pipe and the second delivery pipe are configured to be located on a plane, which is substantially perpendicular to an axial direction of the plurality of injectors.

6. The fuel supply pipe device according to claim 5, wherein the first delivery pipe includes a first body portion, which is substantially in a linear shape, and at least one first projection each protruding from the first body portion on a plane, which is perpendicular to the axial direction of the plurality of injectors, each of the at least one first projection is mounted with the at least one of the plurality of injectors, the second delivery pipe includes a second body portion, which is substantially in a linear shape, and at least one second projection each protruding from the second body portion on a plane, which is perpendicular to the axial direction of the plurality of injectors, each of the at least one second projection is mounted with the other of the plurality of injectors, and the at least one first projection and the at least one second projection are configured to be substantially linearly located on a same plane.

7. The fuel supply pipe device according to claim 1, wherein the at least one of the plurality of injectors is directed in a first axial direction, the other of the plurality of injectors is directed in a second axial direction, the first axial direction and the second axial direction are different from each other, the first delivery pipe is mounted with the at least one of the plurality of injectors, and the second delivery pipe is mounted with the other of the plurality of injectors.

8. The fuel supply pipe device according to claim 1, wherein a distance between the one of the plurality of injectors and the other of the plurality of injectors are adjustable by moving the first delivery pipe and the second delivery pipe relatively to each other.

9. The fuel supply pipe device according to claim 1, wherein the first delivery pipe and the second delivery pipe are fixed via stationary portions located at the same location.

10. The fuel supply pipe device according to claim 1, wherein the plurality of injectors includes two injectors, the two injectors are located corresponding to two intake valves in each of the plurality of cylinders, the first delivery pipe is provided with the one of the two injectors, which corresponds to one of the two intake valves in each of the plurality of cylinders, and the second delivery pipe is provided with the other of the two injectors, which corresponds to the other of the two intake valves in each of the plurality of cylinders.

11. The fuel supply pipe device according to claim 1, wherein a number of the plurality of fuel passages is the same as a number of the plurality of injectors in each cylinder, the plurality of fuel passages is partitioned from each other by a partition wall in a delivery pipe, the plurality of fuel passages is supplied with fuel respectively through the plurality of fuel paths, which are separated from each other, and the plurality of injectors are separately connected respectively to the plurality of fuel passages in each cylinder.

12. The fuel supply pipe device according to claim 11, wherein the delivery pipe includes a plurality of mounting pipes for guiding fuel respectively from the plurality of fuel passages to the plurality of injectors, and the plurality of mounting pipes respectively has cup portions, which are configured to be respectively inserted with fuel inlet portions of the plurality of injectors.

13. The fuel supply pipe device according to claim 12, wherein the plurality of injectors respectively have protruding portions, which respectively protrude from the cup portions in a state where the fuel inlet portions are respectively inserted and in contact with open ends of the cup portions in each cylinder, the protruding portions respectively have lengths, which are different from each other in each cylinder, and the open ends of the plurality of cup portions are located respectively at positions, which are different from each other in a direction in which the fuel inlet portions are inserted, in each cylinder.

14. The fuel supply pipe device according to claim 11, wherein the plurality of injectors provided in each cylinder includes two injectors, and the plurality of fuel passages in the delivery pipe includes two fuel passages.

15. The fuel supply pipe device according to claim 14, wherein the delivery pipe is partitioned into the two fuel passages by the partition wall, which is substantially in a plate shape.

16. The fuel supply pipe device according to claim 14, wherein the delivery pipe is partitioned into the two fuel passages by the partition wall, which is substantially in a tubular shape.

17. The fuel supply pipe device according to claim 11, wherein all of the plurality of fuel passages respectively have volumes, which are substantially the same as each other.

18. The fuel supply pipe device according to claim 11, wherein the internal combustion engine is an inline multi-cylinder engine, and all of the plurality of injectors are provided to a cylinder head of the inline multi-cylinder engine such that axes of the plurality of injectors are substantially in parallel with each other and the plurality of injectors are arranged on one line substantially along a direction of the cylinder bank.

19. A fuel injection device comprising:

a fuel pump for pressure feeding fuel;

the delivery pipe according to claim 11 for accumulating fuel supplied from the fuel pump; and the plurality of injectors.

20. The fuel supply pipe device according to claim 1, wherein the plurality of fuel passages are branched from one passage at the plurality of paths.

21. The fuel supply pipe device according to claim 1, wherein the first delivery pipe and the second delivery pipe are configured to be combined such that all the plurality of injectors are substantially linearly arranged on a single line, which is substantially straight and extends along both an axial direction of the first delivery pipe and an axial direction of the second delivery pipe.

* * * * *